United States Patent [19]

Hörler

[11] Patent Number: 4,648,790

[45] Date of Patent: Mar. 10, 1987

[54] AXIAL TURBINE FOR EXHAUST GAS TURBOCHARGERS

[75] Inventor: Hansulrich Hörler, Zürich, Switzerland

[73] Assignee: BBC Brown, Boveri & Company, Limited, Baden, Switzerland

[21] Appl. No.: 623,199

[22] Filed: Jun. 21, 1984

[30] Foreign Application Priority Data

Jun. 29, 1983 [CH] Switzerland ..... 3559/83

[51] Int. Cl.[4] ..... F01D 9/02

[52] U.S. Cl. ..... 415/112; 415/208

[58] Field of Search ..... 415/208, 217, 182, 199.4, 415/199.5, 218, 94, 95, 112, 180, 176, 175, 116, 120, 103, 143, 203, 204, 205; 416/185, 199

[56] References Cited

U.S. PATENT DOCUMENTS

| | | | |
|---|---|---|---|
| 1,358,070 | 11/1920 | Flory | 415/205 |
| 1,803,220 | 4/1931 | Thompson | 415/208 |
| 2,781,999 | 9/1955 | Brennecke . | |
| 2,854,212 | 9/1958 | Lantermann | 415/218 |
| 3,532,444 | 10/1970 | Strub | 415/112 |
| 3,859,008 | 1/1975 | Wiester | 415/208 |

FOREIGN PATENT DOCUMENTS

| | | | |
|---|---|---|---|
| 0093462 | 11/1983 | European Pat. Off. . | |
| 0964197 | 10/1982 | U.S.S.R. | 415/217 |
| 0966316 | 10/1982 | U.S.S.R. | 415/182 |

OTHER PUBLICATIONS

*The Aircraft Gas Turbine Engine and Its Operation*, PWA Oper. Instr. 200, United Aircraft Corporation (1970), pp. 86–89.

*Primary Examiner*—Everette A. Powell, Jr.

*Attorney, Agent, or Firm*—Burns, Doane, Swecker & Mathis

[57] ABSTRACT

In an axial turbine for exhaust gas turbochargers, the inner wall of the rotationally symmetrical exhaust gas deflection duct is designed as a deflection collar rigidly connected to the turbocharger shaft and rotating with it. The outer diameter of the deflection collar is greater than the diameter of the turbine disc and, at maximum, equal to the outer diameter of the turbine rotor. An element for contactless sealing of the exhaust gas deflection duct is provided between the rotating deflection collar and the casing. The element for contactless sealing of the deflection duct preferably consists of two labyrinth seals located on a cylindrical surface opening inwards, the sealing air being supplied radially from within between the labyrinth seals by means of a sealing air duct.

8 Claims, 2 Drawing Figures

AXIAL TURBINE FOR EXHAUST GAS TURBOCHARGERS

FIELD OF THE INVENTION

The present invention concerns axial turbines generally, and more particularly, axial turbines for exhaust gas turbochargers having turbine inlet ducting which rotates with the turbine.

BACKGROUND OF THE INVENTION

In turbochargers for internal combustion engines, it is aerodynamically advantageous to first let the engine exhaust gas flow inwards through an entry volute or through guide vanes over the complete periphery while imparting the necessary swirl and subsequently, after deflection, through the axial turbine.

An axial turbine having a radial flow turbine guide apparatus of the type mentioned above is shown in the European patent application No. 0 093 462 published Nov. 9, 1983 (FIG. 2).

In this device, the inner wall of the gas deflection duct located between the turbine guide apparatus and the turbine rotor blades is fixed and immovable. Because of gas friction on this wall, a loss of swirl occurs. Due to the high peripheral gas velocity, which increases in the radially inward direction, this inner wall of the gas deflection duct causes relatively high frictional losses. The isentropic efficiency of the turbine is reduced due to this by an additive 2% to 5% approximately.

OBJECT AND SUMMARY OF THE INVENTION

The object of the invention is, therefore, to produce an axial turbine in which the loss of swirl in the gas deflection duct is reduced to a minimum and in which, consequently, a good efficiency is achieved.

This object is obtained by an axial turbine constructed in accordance with the present invention, wherein the engine exhaust gas, after it has been accelerated at the inlet volute or the turbine guide vanes by a peripheral component, is supplied to the turbine rotor blades via an exhaust gas deflection duct, which duct includes a deflection collar rigidly attached to the turbocharger shaft. By such an arrangement an improvement in efficiency is obtained.

BRIEF DESCRIPTION OF THE DRAWING

In the drawing, two preferred embodiments of the subject invention are shown in a simplified representation, wherein.

The same parts are provided with the same reference numbers in both figures. The flow directions of the working medium are indicated by arrows. Parts of the axial turbine which are not essential to the invention, such as the turbine exhaust duct, consoles and fastening elements, are omitted.

DETAILED DESCRIPTION OF THE PREFERRED EMBODIMENTS

Figure 1:
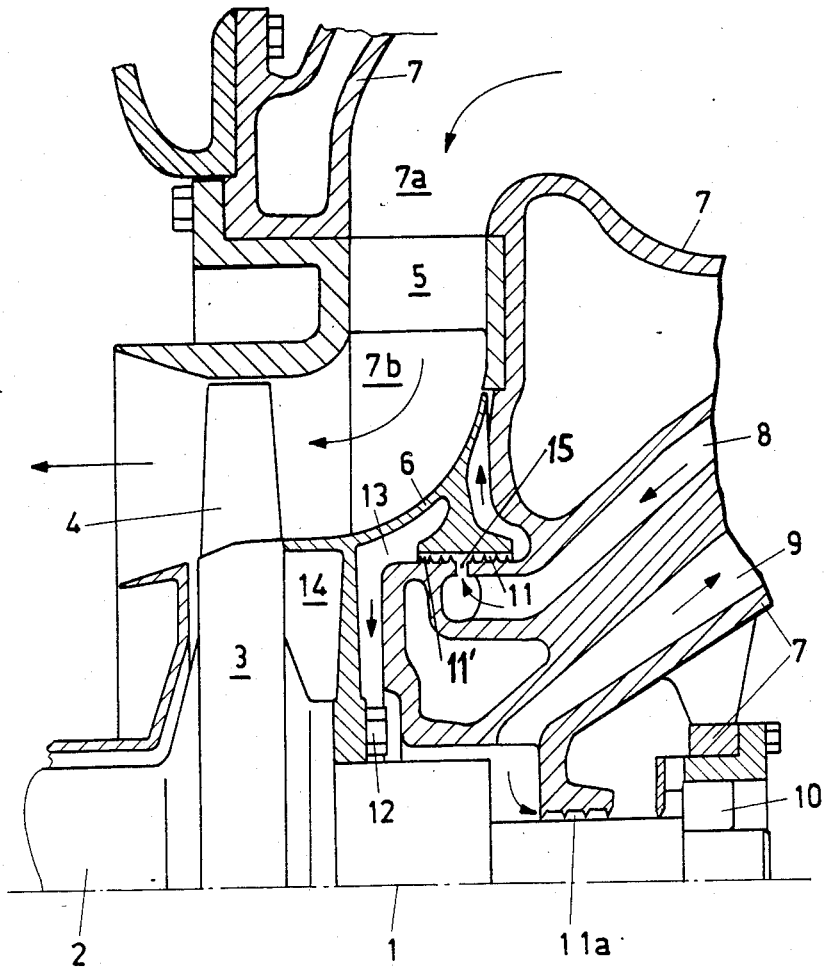
FIG. 1 is a partially sectional side-view of an axial turbine of an exhaust gas turbocharger constructed in accordance with a first preferred embodiment of the present invention.

In FIG. 1, the turbocharger axis is indicated by 1. The axial turbine shown, which has radial gas inlet flow, is connected via the turbine casing 7 to an exhaust pipe (not shown) of a supercharged diesel engine. The turbocharger shaft 2 is supported in the turbine casing 7 by means of the shaft bearing 10 and it carries a turbine disc 3 provided with the turbine rotor blades 4. Radial flow turbine guide vanes 5 are located in the gas upstream of the axial flow turbine rotor blades 4 in the annular deflection duct *7a*. A sealing air duct 8 and an air bypass duct 9 are also located in the turbine casing 7.

In accordance with the invention, the inner wall of the rotationally symmetrical exhaust gas deflection duct *7b* is designed as a deflection collar 6 rotating with the turbocharger shaft 2. This deflection collar 6 is rigidly connected by means of screws 12 to the turbocharger shaft 2. The outer diameter of the rotating deflection collar 6 is larger than the diameter of the turbine disc 3 and can, at maximum, be equal to the outer diameter of the turbine rotor. An element for contactless sealing of the exhaust gas deflection duct is provided between the rotating deflection collar 6 and the casing 7. This element consists of two labyrinth seals 11, 11', which are located on a cylindrical concentric surface of the deflection collar 6 opening inwards. A sealing air duct 8 located in the turbine casing 7 is connected to a radial gap 15 located between the labyrinth seal 11 facing towards the turbine and the labyrinth seal 11' facing away from the turbine. An air by-pass duct 9 located in the turbine casing 7 is connected to an air space 13.

The method of operation of the axial turbine for exhaust gas turbochargers is described below.

The engine exhaust gas flows through the exhaust gas duct *7a*, through the ring of guide vanes 5 and the exhaust gas deflection duct *7b* to the turbine rotor blades 4, in which it expands with a release of power, and is finally expelled to atmosphere through an exhaust pipe, which is not shown. The engine exhaust gas, which arrives in a mainly radial direction, is tangentially accelerated in the turbine guide vanes 5. Due to this, a swirl acting in the rotational direction of the turbine appears.

Since the inner wall of the exhaust gas deflection duct *7b* rotates with the turbocharger shaft 2, the relative velocity between the tangential gas velocity and the rotating wall is substantially less, in this zone, than in the case of axial turbines without a rotating deflection collar. The resulting gain in turbine efficiency, due to the decreased friction, is approximately an additive 1.5 to 3%.

The sealing air supply through the sealing air duct 8 serves to cool the turbocharger shaft 2 and the turbine disc 3 and prevents the leakage of exhaust gas from the exhaust gas deflection duct *7b* through the air space 13 to the shaft bearing 10 and its surroundings.

A frictional braking force occurs in the air space 13 on the side of the deflection collar 6 facing away from the gas flow, but this force is relatively small. The resultant axial force acting on the turbocharger shaft 2 depends, among other things, on the pressure distribution on the two sides of the deflection collar 6. Since the labyrinth seals 11 are located radially well out, this resultant axial force is greatly reduced and corresponds approximately to that of a radial turbine. Due to the flow losses in the labyrinth seal 11, the air pressure in the air space 13 behind the deflection collar 6 is reduced to approximately ambient pressure. Due to this, the axial force on the turbocharger shaft becomes small. With this arrangement, the sealing air consumption is somewhat greater than that in arrangements without rotating deflection collars 6.

Figure 2:
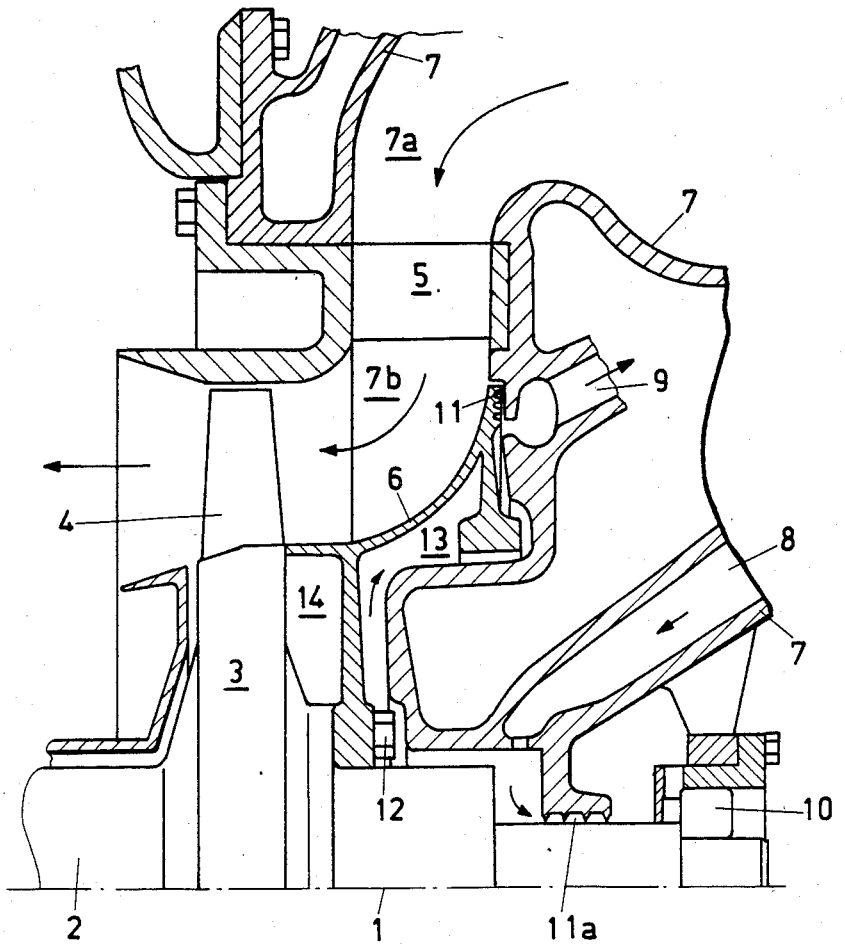
FIG. 2 is a modification of the arrangement of FIG. 1.

In the embodiment shown in FIG. 2, the element for contactless sealing of the deflection duct 7*b* consists of a labyrinth seal 11 located concentrically in a plane normal to the axis. The labyrinth seal 11 is located on the outer diameter of the rotating deflection collar 6. The small exhaust gas quantity flowing from the exhaust gas deflection duct 7*b* inwards through the labyrinth seal 11 is led away into the by-pass duct 9 together with the sealing air flowing radially outwards from within. The sealing air consumption in this arrangement is smaller than that in the case of arrangements not having rotating deflection collars 6. This sealing air consumption is mainly determined by the cooling necessary for the deflection collar. A very small quantity of engine exhaust gas is lost here through the labyrinth seal 11. This loss of gas is also negligible because of the low gas density. One main advantage of this arrangement is that the axial force on the turbocharger shaft practically disappears.

What is claimed is:

1. In an axial turbine for exhaust gas turbochargers of the type including a turbocharger shaft, a turbine rotor connected to the turbocharger shaft, said turbine rotor having a turbine disc and axial flow turbine rotor blades connected to the turbine disc, a turbine casing in which the turbine shaft is supported, a ring of radial flow turbine guide vanes located in the turbine casing upstream of the rotor blades and a rotationally symmetrical exhaust gas deflection duct located between the turbine guide vanes and the turbine rotor blades, said turbine guide vanes tangentially accelerating exhaust gases entering said deflection duct, the improvement comprising a radially inner wall of the rotationally symmetrical exhaust gas deflection duct being a deflection collar which collar is bladeless and rigidly connected with the turbocharger shaft so as to rotate with it, whereby friction between the exhaust gases and said deflection duct is reduced.

2. The axial turbine in accordance with claim 1, an outer diameter of the deflection collar is greater than an outer diameter of the turbine disc and not greater than an outer diameter of the turbine rotor.

3. The axial turbine in accordance with claim 1, wherein an element for contactless sealing of the exhaust gas deflection duct is provided between the rotating deflection collar and the turbine casing.

4. The axial turbine in accordance with claim 3, wherein the element for contactless sealing of the deflection duct is two labyrinth seals located on a cylindrical concentric surface of the deflection collar facing radially inwards, the first of said labyrinth seals being closer to the turbine than the second labyrinth seal, the axial turbine further comprising a sealing air duct which is located in the turbine casing and is connected to a radial gap located between the first labyrinth seal and the second labyrinth seal so that sealing air can be supplied radially from within through the radial gap and can be led away through the second labyrinth seal to the outer radius of the deflection collar into the exhaust gas deflection duct in front of the turbine and through the first labyrinth seal to the outer atmosphere or into an exhaust gas pipe.

5. The axial turbine in accordance with claim 3, wherein the element for contactless sealing of the deflection duct is a labyrinth seal concentrically located in a plane normal to the axis of said turbine, the axial turbine further comprising a by-pass duct by-passing said turbine rotor blades and means for directing sealing air to the labyrinth seal, the by-pass duct communicating with the labyrinth seal so that the engine exhaust gas which flows from the exhaust gas deflection duct through the labyrinth seal can be led into the by-pass duct together with the sealing air.

6. The axial turbine in accordance with claim 1, wherein said deflection collar at its downstream end includes an axial flange extending substantially to a radially outward portion of said turbine disc.

7. In an axial turbine for exhaust gas turbochargers of the type including a turbine casing, a turbine rotor rotatably mounted in said turbine casing, said turbine rotor having a turbine disc and axial flow turbine rotor blades connected to the turbine disc, a ring of radial flow turbine guide vanes located in the turbine casing upstream of the rotor blades and a rotationally symmetrical exhaust gas deflection duct located between the turbine guide vanes and the turbine rotor blades, said turbine guide vanes tangentially accelerating exhaust gases entering said deflection duct so as to create a swirling flow condition in a portion of said deflection duct adjacent said turbine rotor blades, the improvement comprising means for conserving said swirling flow condition including a radially inner wall of the rotationally symmetrical exhaust gas deflection duct being a deflection collar which collar is connected with the turbine rotor so as to rotate with it, whereby friction between the exhaust gases and said deflection duct is reduced.

8. The axial turbine n accordance with claim 7, wherein said deflection collar at its downstream end includes an axial flange extending substantially to a radially outward portion of said turbine disc.

* * * * *